US008872757B2

(12) United States Patent
Kim

(10) Patent No.: US 8,872,757 B2
(45) Date of Patent: Oct. 28, 2014

(54) MOBILE TERMINAL AND METHOD OF CONTROLLING THE SAME

(75) Inventor: Taeyun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 223 days.

(21) Appl. No.: 13/457,364

(22) Filed: Apr. 26, 2012

(65) Prior Publication Data

US 2012/0281027 A1 Nov. 8, 2012

(30) Foreign Application Priority Data

May 2, 2011 (KR) ..... 10-2011-0041335

(51) Int. Cl.
*G09G 3/36* (2006.01)
*G09G 3/34* (2006.01)

(52) U.S. Cl.
CPC ..... *G09G 3/3406* (2013.01); *G09G 2340/06* (2013.01); *G09G 2320/062* (2013.01); *G09G 2360/16* (2013.01); *G09G 2320/064* (2013.01); *G09G 2330/021* (2013.01); *G09G 2320/0646* (2013.01)
USPC ..... 345/102; 362/97.2

(58) Field of Classification Search
CPC ..... G09G 3/34; G09G 3/3406; G09G 3/3413; G09G 3/342; G09G 2320/062; G09G 2320/064; G09G 2320/0646; G09G 2330/021; G09G 2340/06; G09G 2360/16
USPC ..... 345/102, 690; 362/97.1, 97.2
See application file for complete search history.

(56) References Cited

U.S. PATENT DOCUMENTS

| | | | | |
|---|---|---|---|---|
| 2005/0146532 | A1* | 7/2005 | Miyazaki et al. | 345/600 |
| 2005/0219188 | A1* | 10/2005 | Kawabe et al. | 345/94 |
| 2006/0109198 | A1* | 5/2006 | Chow et al. | 345/1.1 |
| 2006/0262111 | A1 | 11/2006 | Kerofsky | |
| 2008/0007514 | A1* | 1/2008 | Tanaka | 345/102 |
| 2009/0102783 | A1* | 4/2009 | Hwang et al. | 345/102 |
| 2009/0109232 | A1* | 4/2009 | Kerofsky | 345/589 |
| 2009/0167672 | A1* | 7/2009 | Kerofsky | 345/102 |
| 2009/0167789 | A1* | 7/2009 | Kerofsky | 345/690 |
| 2009/0267876 | A1* | 10/2009 | Kerofsky | 345/87 |
| 2010/0053222 | A1* | 3/2010 | Kerofsky | 345/690 |
| 2010/0156964 | A1* | 6/2010 | Masuda et al. | 345/691 |
| 2010/0253846 | A1* | 10/2010 | Fergason et al. | 348/576 |
| 2012/0249610 | A1* | 10/2012 | Katagami et al. | 345/690 |

FOREIGN PATENT DOCUMENTS

| | | |
|---|---|---|
| CN | 101048810 | 10/2007 |
| CN | 101647057 | 2/2010 |
| CN | 101763830 | 6/2010 |
| CN | 101783115 | 7/2010 |

OTHER PUBLICATIONS

The State Intellectual Property Office of the People's Republic of China Application Serial No. 201210135001.8, Office Action dated Jan. 15, 2014, 7 pages.

* cited by examiner

*Primary Examiner* — Tom Sheng
(74) *Attorney, Agent, or Firm* — Lee, Hong, Degerman, Kang & Waimey

(57) ABSTRACT

Disclosed are a mobile terminal and a method of controlling a mobile terminal. A different backlight dimming algorithm can be applied according to an application, and a dimming algorithm is selectively applied in association with an input image during executing of a specific application.

22 Claims, 11 Drawing Sheets

< 601 format >

RGB to YCbCr converting formula $$Y_601 = 0.257R + 0.504G + 0.098B + 16$$
$$Cb = -0.148R - 0.291G + 0.439B + 128$$
$$Cr = 0.439R - 0.368G - 0.071B + 128$$

YCbCr to RGB converting formula $$R = 1.164(Y_601 - 16) + 1.596(Cr - 128)$$
$$G = 1.164(Y_601 - 16) - 0.813(Cr - 128) -0.391(Cb - 128)$$
$$B = 1.164(Y_601 - 16) + 2.018(Cb - 128)$$

solution $$R = 1.164*Y_601 + 1.596*Cr - 222.912$$
$$G = 1.164*Y_601 - 0.813*Cr - 0.391*Cb + 135.488$$
$$B = 1.164*Y_601 + 2.018*Cb - 276.928$$

< 709 format >

RGB to YCbCr converting formula $$Y_709 = 0.183R + 0.614G + 0.062B + 16$$
$$Cb = -0.101R - 0.338G + 0.439B + 128$$
$$Cr = 0.439R - 0.399G - 0.040B + 128$$

YCbCr to RGB converting formula $$R = 1.164(Y_709 - 16) + 1.793(Cr - 128)$$
$$G = 1.164(Y_709 - 16) - 0.534(Cr - 128) - 0.213(Cb - 128)$$
$$B = 1.164(Y_709 - 16) + 2.115(Cb - 128)$$

solution $$R = 1.164*Y_709 + 1.793*Cr - 248.128$$
$$G = 1.164*Y_709 - 0.534*Cr - 0.213*Cb + 114.24$$
$$B = 1.164*Y_709 + 2.115*Cb - 252.096$$

| dimming algorithm | application |
|---|---|
| Type 1 | video player, photo album, internet browser, background, graphic game |
| Type 2 | text message, configuration, convenient function |
| Type 3 | traffic information, application non-graphic game |
| Type 4 | still image viewer |

MOBILE TERMINAL AND METHOD OF CONTROLLING THE SAME

CROSS-REFERENCE TO RELATED APPLICATIONS

Pursuant to 35 U.S.C. §119(a), this application claims the benefit of earlier filing and right of priority to Korean Patent Application No. 10-2011-0041335 filed on May 2, 2011, the contents of which are hereby incorporated by reference herein in its entirety.

BACKGROUND

1. Field

Embodiments of the present invention may relate to a mobile terminal and a method of controlling the same, enabling the application of a backlight dimming algorithms according to an application.

2. Related Art

An active matrix type liquid crystal display displays an image by using a thin film transistor (hereinafter, referred to as a "TFT") as a switching device. The liquid crystal display is advantageous over a cathode ray tube (CRT) in terms of miniaturization, thus rapidly replacing the CRT in the applications fields of portable information devices, office machines, and computers as well as televisions.

The liquid crystal display is not a self-emissive device and thus requires a backlight unit for light emission to a liquid crystal display panel. The liquid crystal display is being utilized as a display device for a portable information device. To extend the useful life of a battery in the portable information device, the liquid crystal display needs to achieve a reduction in power consumption. Power consumed by light sources of a backlight unit and an inverter circuit for driving the light sources is almost half of the overall power consumed by the liquid crystal display. Therefore, it is effective to reduce power consumption in the backlight unit in order to reduce the power consumption of the liquid crystal device.

As for a method of reducing power consumption in the backlight unit, a backlight dimming method is in the widest use. The backlight dimming method may be divided into a local backlight dimming method and a global backlight dimming method. In the local backlight dimming method, a display area is divided into a plurality of blocks, and each of the blocks is individually controlled in terms of the luminance of the backlight, while in the global backlight dimming method, the luminance of the backlight is collectively lowered for the entire display area. The local backlight dimming method allows the luminance of a display area to be locally controlled within a single frame period, thus being desirably contributive to improving static contrast and reducing power consumption; however, it has limitations due to its high complexity of the algorithm and hardware and its poor applicability only for a direct type light emitting diode (LED) backlight unit which allows for easy luminance control upon each block. Meanwhile, the global backlight dimming method has low complexity in the algorithm and hardware and is easily applicable to any type of backlight unit.

SUMMARY

Accordingly, one object of the present invention is to address the above-noted and other drawbacks of the related art.

Another object of the present invention is to provide a mobile terminal and a method of controlling the same, enabling the application of a different backlight dimming algorithm depending on an application.

Also, another object of the present invention is to provide a mobile terminal and a method of controlling the same, enabling the selective application of a dimming algorithm in association with an input image during the execution of a specific application.

To accomplish the objects of the present invention, according to an aspect of the present invention, there is provided a mobile terminal including: a liquid crystal display panel; a backlight unit emitting backlight to the liquid crystal display panel; and a controller selecting a dimming algorithm from among a plurality of dimming algorithms according to an application, and controlling luminance of the backlight unit, wherein, when an input image having a luminance value falling outside a preset reference range is displayed on the liquid crystal display panel during execution of a specific application, the controller controls luminance of the backlight unit by applying a dimming algorithm which is different from the selected dimming algorithm according to the specific application.

According to another aspect of the present invention, there is provided a method of controlling a mobile terminal, the method comprising: when a specific application is called for, selecting a dimming algorithm according to the specific application, and controlling luminance of a backlight unit emitting backlight to a liquid crystal display panel of the mobile terminal; and when an input image having a luminance value falling outside a preset reference range is displayed on the liquid crystal display panel during execution of the specific application, controlling luminance of the backlight unit by applying a dimming algorithm which is different from the dimming algorithm selected according to the specific application.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Figure 1:
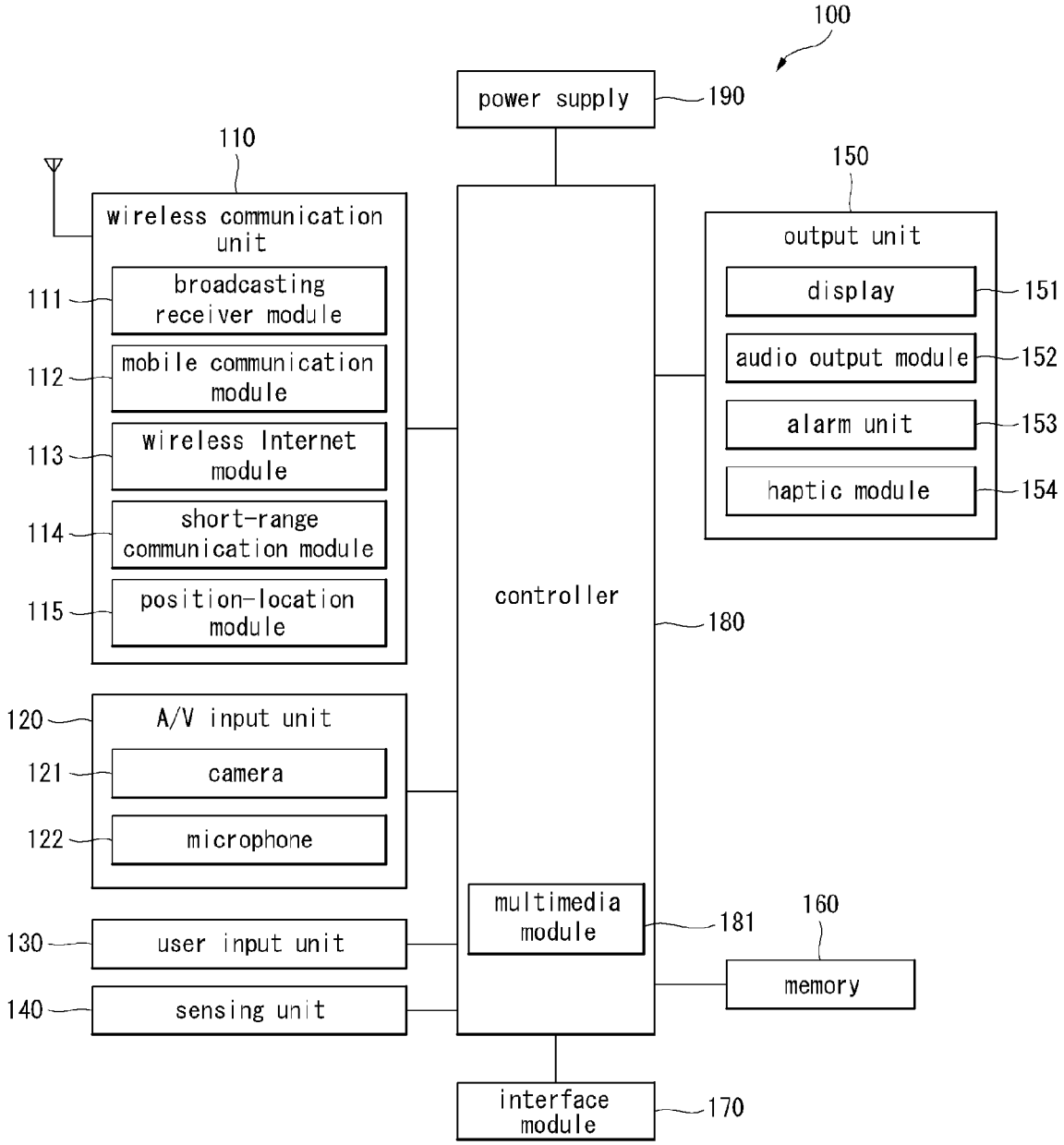
FIG. 1 is a block diagram of a mobile terminal according to an example embodiment.

Objects, advantages, and features of the present invention will be clarified through following embodiments described with reference to the accompanying drawings. Reference will now be made in detail to the preferred embodiments of the present invention, examples of which are illustrated in the accompanying drawings. In the drawings, the same reference numerals will be used throughout to designate the same or like elements. Also, detailed descriptions with regard to well known functions and configurations, which may obscure the substance of the present invention, will be omitted.

Hereinafter, a mobile terminal related to the present invention will be described in more detail with reference to the accompanying drawings. The suffixes 'module', 'unit' and 'part' may be used for elements in order to facilitate the disclosure. Significant meanings or roles may not be given to the suffixes themselves and it is understood that the 'module', 'unit' and 'part' may be used together or interchangeably.

Embodiments of the present invention may be applicable to various types of terminals. Examples of such terminals may include mobile phones, smart phones, laptop computers, digital broadcast terminals, personal digital assistants, portable multimedia players (PMP) and/or navigators.

FIG. 1 is a block diagram of a mobile terminal in accordance with an example embodiment.

The mobile terminal 100 includes a wireless communication unit 110, an audio/video (A/V) input unit 120, a user input unit 130, a sensing unit 140, an output unit 150, a memory 160, an interface unit 170, a controller 180 and a power supply 190. Other embodiments and arrangements may also be provided. FIG. 1 shows a mobile terminal 100 having various components, although other components may also be used. More or less components may alternatively be implemented.

The components will now be described.

The wireless communication unit 110 may be configured with one or more modules enabling wireless communication between the mobile terminal 100 and a wireless communication system or between the mobile terminal 100 and a network where the mobile terminal 100 is located. For example, the wireless communication unit 110 may include a broadcast receiving module 111, a mobile communication module 112, a wireless Internet module 113, a short-range communication module 114 and a position-location module 115.

The broadcast receiving module 111 may receive a broadcast signal and/or broadcast associated information from an external broadcast managing server via a broadcast channel.

The broadcast channel may include a satellite channel and a terrestrial channel. The broadcast managing server may refer to a server that generates a broadcast signal and/or broadcast associated information and transmits it or a server that receives a generated broadcast signal and/or broadcast associated information and transmits it to a terminal. The broadcast signal may be a TV broadcast signal, a radio broadcast signal, and/or a data broadcast signal. The broadcast signal may further include a broadcast signal combined with a TV or radio broadcast signal.

Examples of broadcast associated information may include information associated with a broadcast channel, a broadcast program, a broadcast service provider, etc. The broadcast associated information may be provided via a mobile communication network. In this case, the broadcast associated information may be received by the mobile communication module 112.

The broadcast associated information may be in various forms. For example, broadcast associated information may include an electronic program guide (EPG) of digital multimedia broadcasting (DMB) and an electronic service guide (ESG) of digital video broadcast-handheld (DVB-H).

The broadcast receiving module 111 may receive broadcast signals transmitted from various types of broadcast systems. In particular, the broadcast signals may be received by using a digital broadcasting system, such as digital multimedia broadcasting-terrestrial (DMB-T), digital multimedia broadcasting-satellite (DMB-S), digital video broadcast-handheld (DVB-H), a data broadcasting system known as media forward link only (MediaFLO) or integrated services digital broadcast-terrestrial (ISDB-T). Of course, the broadcast receiving module 111 may be configure to be suitable to the above digital broadcasting systems as well as other broadcast systems providing broadcast signals.

The broadcast signals and/or broadcast associated information received through the broadcast receiving module 111 may be stored in the memory 160.

The mobile communication module 112 may communicate wireless signals with at least one of a base station, an external terminal and a server. The signals may represent audio, video, multimedia, control signaling, and data, etc.

The wireless Internet module 113 refers to a module for wireless Internet access. This wireless Internet module 113 may be internally or externally coupled to the mobile terminal 100. Suitable technologies for wireless Internet may include, but are not limited to, WLAN (Wireless LAN)(Wi-Fi), Wibro (Wireless broadband), Wimax (World Interoperability for Microwave Access), and/or HSDPA (High Speed Downlink Packet Access).

The short-range communication module 114 refers to a module for short-range communications. Suitable technologies for short-range communication may include, but are not limited to, Bluetooth, radio frequency identification (RFID), infrared data association (IrDA), ultra-wideband (UWB), ZigBee, and the like.

The position-location module 115 may identify or otherwise obtain a location of the mobile terminal 100. The position-location module 115 may obtain information regarding a location by using a global Navigation Satellite System (GNSS). Here, the GNSS is a term used to explain wireless navigation satellite systems that revolve around the earth to send reference signals allowing predetermined types of wireless navigation receivers to determine their locations on or in the vicinity of the surface of the earth. Non-limiting examples of the GNSS may include Global Position System in the United Sates, Galileo in Europe, Global Orbiting Navigational Satellite System (GLONASS) in Russia, COMPASS in China, Quasi-Zenith Satellite System in Japan, etc.

For example, the position-location module 115 may be a GPS module, a representative example of the GNSS. The GPS module may precisely calculate current 3-dimensional position information based on longitude, latitude and altitude by calculating distance information and precise time information from at least three satellites and then by applying triangulation to the calculated information. Location and time information may be calculated using three satellites, and errors of the calculated location position and time information may then be amended or changed using another satellite. The GPS module may calculate speed information by continuously calculating a real-time current location.

Referring to FIG. 1, the audio/video (A/V) input unit 120 may provide audio or video signal input to the mobile terminal 100. The A/V input unit 120 may include a camera 121, a microphone 122 and the like. The camera 121 processes image frames such as still pictures or videos obtained by an image sensor in a video phone call mode or a picture taking module. The processed image frames may be displayed on the display 151.

The image frames processed in the camera 121 may be stored in the memory 160 or externally sent through the wireless communication unit 110. According to a configuration aspect of the terminal, two or more cameras 121 may be provided.

The microphone 122 may receive an external audio signal while the mobile terminal is in a particular mode, such as a phone call mode, a recording mode and/or a voice recognition mode, and then process it into an electrical audio data. In the case of the phone call module, the processed audio data may be converted into a form transmittable to the mobile communication terminal through the mobile communication module 112. The microphone 122 may be provided with various noise removing algorithms (or noise canceling algorithms) to remove noise generated in the course of receiving the external audio signal.

The user input unit 130 may generate input data responsive to user manipulation. Examples of the user input unit 130 may include a keypad, a dome switch, a touchpad (e.g., static pressure/capacitance), a jog wheel and/or a jog switch.

The sensing unit 140 may provide status measurements of various aspects of the mobile terminal 100. For example, the sensing unit 140 may detect current states of the mobile terminal 100 such as an open/close status (or state) of the mobile terminal 100, a position of the mobile terminal 100 or a component of the mobile terminal 100, a presence or absence of user contact with the mobile terminal 100, and/or an orientation or acceleration/deceleration of the mobile terminal 100, and then generates a sensing signal for controlling the operation of the mobile terminal 100. For example, the mobile terminal 100 may be configured as a slide-type mobile terminal. In such a configuration, the sensing unit 140 may sense whether a sliding portion of the mobile terminal 100 is open or closed. The sensing unit 140 may also sense presence or absence of power provided by the power supply 190, presence or absence of a coupling or other connection between the interface unit 170 and an external device, etc. The sensing unit 140 may include a proximity sensor 141.

The output unit 150 may generate an output relevant to a sight sense, an auditory sense, a tactile sense and/or the like. The output unit 150 may include a display 151, an audio output module 152, an alarm 153, a haptic module 154 and/or the like.

The display 151 may display (output) information processed by the terminal 100. For example, in the case that the terminal is in a call mode, the display 151 may display a user interface (UI) or a graphic user interface (GUI) associated with the call. If the mobile terminal 100 is in a video communication mode or a photograph mode, the display 151 may display a photographed and/or received picture, a UI or a GUI.

The display 151 may include at least one of a liquid crystal display (LCD), a thin film transistor liquid crystal display (TFT LCD), an organic light-emitting diode (OLED), a flexible display, and a 3-dimensional display.

The display 151 may have a transparent or light-transmittive type configuration to enable an external environment to be seen through. This may be called a transparent display. A transparent LCD may be an example of a transparent display. A backside structure of the display 151 may also have the light-transmittive type configuration. In this configuration, a user may see an object located behind the terminal body through the area occupied by the display 151 of the terminal body.

At least two displays 151 may also be provided. For example, a plurality of displays may be provided on a single face of the terminal 100 by being built in one body or spaced apart from the single face. Alternatively, each of a plurality of displays may be provided on different faces of the terminal 100.

If the display 151 and a sensor for detecting a touch action (hereafter a touch sensor) are constructed in a mutual-layered structure (hereafter a touchscreen), the display 151 may be used as an input device as well as an output device. For example, the touch sensor may include a touch film, a touch sheet, a touchpad and/or the like.

The touch sensor may convert a pressure applied to a specific portion of the display 151 or a variation of electrostatic capacity generated from a specific portion of the display 151 to an electric input signal. The touch sensor may detect a pressure of a touch as well as a position and size of the touch.

If a touch input is provided to the touch sensor, signal(s) corresponding to the touch input may be transferred to a touch controller. The touch controller may process the signal(s) and then transfer corresponding data to the controller 180. The controller 180 may therefore know which portion of the display 151 is touched.

Referring to FIG. 1, a proximity sensor can be provided within the mobile terminal 100 enclosed by the touchscreen or around the touchscreen. The proximity sensor may detect a presence or non-presence of an object approaching a prescribed detecting surface or an object existing around the proximity sensor using an electromagnetic field strength or infrared ray without mechanical contact. The proximity sensor may have a longer durability than the contact type sensor and may also have a greater usage than the contact type sensor.

Examples of the proximity sensor may include a transmittive photoelectric sensor, a direct reflective photoelectric sensor, a mirror reflective photoelectric sensor, a radio frequency oscillation proximity sensor, an electrostatic capacity proximity sensor, a magnetic proximity sensor, an infrared proximity sensor and/or the like.

If the touchscreen is an electrostatic type, the proximity sensor may detect proximity of a pointer using a variation of an electric field according to the proximity of the pointer. In this case, the touchscreen (touch sensor) may be classified into the proximity sensor.

An action in which a pointer approaches the touchscreen without contacting the touchscreen may be called a proximity touch. An action in which a pointer actually touches the touchscreen may be called a contact touch. The location of the touchscreen proximity-touched by the pointer may be the position of the pointer that vertically opposes the touchscreen when the pointer performs the proximity touch.

The proximity sensor may detect a proximity touch and/or a proximity touch pattern (e.g., a proximity touch distance, a proximity touch duration, a proximity touch position, a proximity touch shift state, etc.). Information corresponding to the detected proximity touch action and/or the detected proximity touch pattern may be outputted to the touchscreen.

The audio output module 152 may output audio data that is received from the wireless communication unit 110 in a call signal reception mode, a call mode, a recording mode, a voice recognition mode, a broadcast receiving mode and/or the like. The audio output module 152 may output audio data stored in the memory 160. The audio output module 152 may output an audio signal relevant to a function (e.g., a call signal receiving sound, a message receiving sound, etc.) performed by the mobile terminal 100. The audio output module 152 may include a receiver, a speaker, a buzzer and/or the like. Also, the audio output module 152 may output audio data through an earphone jack 116. A user can listen to a sound by connecting an earphone to the earphone jack 116.

The alarm 153 may output a signal for announcing an event occurrence of the mobile terminal 100. An event occurring in the mobile terminal 100 may include one of a call signal reception, a message reception, a key signal input, a touch input and/or the like. The alarm 153 may output a signal for announcing an event occurrence by way of vibration or the like as well as a video signal or an audio signal. The video signal may be outputted via the display 151. The audio signal may be outputted via the audio output module 152.

The haptic module 154 may bring about various haptic effects that can be sensed by a user. Vibration is a representative example for the haptic effect brought about by the haptic module 154. Strength and pattern of the vibration generated from the haptic module 154 may be controllable. For example, vibrations differing from each other may be outputted in a manner of being synthesized together or may be sequentially outputted.

The haptic module 154 may generate various haptic effects including a vibration, an effect caused by such a stimulus as a pin array vertically moving against a contact skin surface, a jet power of air via outlet, a suction power of air via inlet, a skim on a skin surface, a contact of an electrode, an electrostatic power and the like, and/or an effect by hot/cold sense reproduction using an endothermic or exothermic device as well as the vibration.

The haptic module 154 may provide the haptic effect via direct contact. The haptic module 154 may enable a user to experience the haptic effect via muscular sense of a finger, an arm and/or the like. Two or more haptic modules 154 may be provided according to a configuration of the mobile terminal 100.

The memory 160 may store a program for operations of the controller 180. The memory 160 may temporarily store input/output data (e.g., phonebook, message, still picture, moving picture, etc.). The memory 160 may store data of vibration and sound in various patterns outputted in case of a touch input to the touchscreen.

The memory 160 may include at least one of a flash memory, a hard disk, a multimedia card micro type memory, a card type memory (e.g., SD memory, XD memory, etc.), a random access memory (RAM), a static random access memory (SRAM), a read-only memory (ROM), an electrically erasable programmable read-only memory, a programmable read-only memory, a magnetic memory, a magnetic disk, an optical disk, and/or the like. The mobile terminal 100 may operate in association with a web storage that performs a storage function of the memory 160 in the Internet.

The interface unit 170 may play a role as a passage to external devices connected to the mobile terminal 100. The interface unit 170 may receive data from an external device. The interface unit 170 may be supplied with a power and then the power may be delivered to elements within the mobile terminal 100. The interface unit 170 may enable data to be transferred to an external device from an inside of the mobile terminal 100. The interface unit 170 may include a wire/wireless headset port, an external charger port, a wire/wireless data port, a memory card port, a port for coupling to a device having an identity module, an audio input/output (I/O) port, a video input/output (I/O) port, an earphone port and/or the like.

The identity module may be a chip or card that stores various kinds of information for authenticating use of the mobile terminal 100. The identify module may include a user identity module (UIM), a subscriber identity module (SIM), a universal subscriber identity module (USIM) and/or the like. A device provided with the above identity module (hereafter an identity device) may be manufactured in the form of a smart card. The identity device may be connected to the mobile terminal 100 via the port.

The interface unit 170 may play a role as a passage for supplying a power to the mobile terminal 100 from a cradle that is connected to the mobile terminal 100. The interface unit 170 may play a role as a passage for delivering various command signals, which are inputted from the cradle by a user, to the mobile terminal 100. Various command signals inputted from the cradle or the power may work as a signal for recognizing that the mobile terminal 100 is correctly loaded in the cradle.

The controller 180 may control overall operations of the mobile terminal 100. For example, the controller 180 may perform control and processing relevant to a voice call, a data communication, a video conference and/or the like. The controller 180 may have a multimedia module 181 for multimedia playback. The multimedia module 181 may be implemented within the controller 180 or may be configured separate from the controller 180.

The controller 180 may perform pattern recognizing processing for recognizing a handwriting input performed on the touchscreen as a character and/or recognizing a picture drawing input performed on the touchscreen as an image.

The power supply 190 may receive an external or internal power and then supply the power required for operations of the respective elements under control of the controller 180.

Embodiments of the present invention explained in the following description may be implemented within a recording medium that can be read by a computer or a computer-like device using software, hardware or combination thereof.

According to the hardware implementation, arrangements and embodiments may be implemented using at least one of application specific integrated circuits (ASICs), digital signal processors (DSPs), digital signal processing devices DSPDs), programmable logic devices (PLDs), field programmable gate arrays (FPGAs), processors, controllers, microcontrollers, microprocessors and electrical units for performing other functions. In some cases, embodiments may be implemented by the controller 180.

For a software implementation, arrangements and embodiments described herein may be implemented with separate software modules, such as procedures and functions, each of which may perform one or more of the functions and operations described herein. Software codes may be implemented with a software application written in any suitable programming language and may be stored in memory such as the memory 160, and may be executed by a controller or processor, such as the controller 180.

Figure 2A:
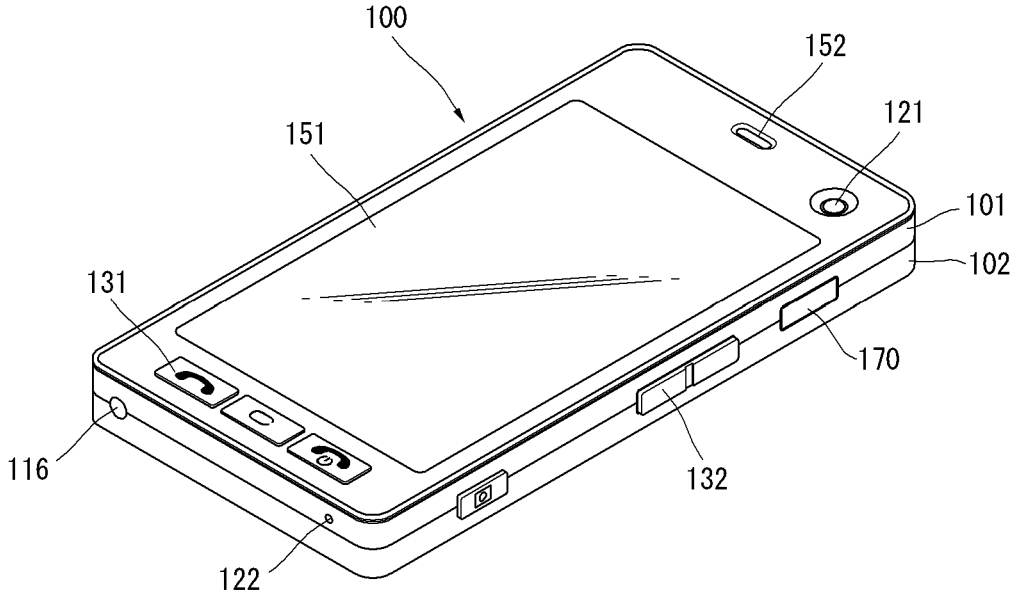
FIG. 2A is a front view of one example of a mobile terminal or a portable terminal associated with an example embodiment of the present invention.

FIG. 2A is a front-view of a mobile terminal according to an example embodiment. Other embodiments, configurations and arrangements may also be provided.

As shown in FIG. 2A, the mobile terminal 100 may include a bar type terminal body. Embodiments of the mobile terminal may be implemented in a variety of different configurations. Examples of such configurations may include a folder-type, a slide-type, a bar-type, a rotational-type, a swing-type and/or combinations thereof.

The body may include a case (casing, housing, cover, etc.) that forms an exterior of the terminal. In this embodiment, the case may be divided into a front case 101 and a rear case 102.

Various electric/electronic parts may be provided in a space between the front case 101 and the rear case 102. A middle case may be further provided between the front case 101 and the rear case 102.

The cases may be formed by injection molding of synthetic resin or may be formed of metal substance such as stainless steel (STS), titanium (Ti) or the like, for example.

The display 151, the audio output unit 152, the camera 121, user input units 130/131/132, the microphone 122, the interface unit 170 and the like may be provided on the terminal body, and more particularly on the front case 101.

The display 151 may occupy most of a main face of the front case 101. The audio output module 152 and the camera 121 may be provided at an area adjacent to one end portion of the display 151, while the user input unit 131 and the microphone 122 may be provided at another area adjacent to the other end portion of the display 151. The user input unit 132 and the interface unit 170 may be provided on lateral sides of the front and rear cases 101 and 102.

The user input unit 130 may receive a command for controlling an operation of the mobile terminal 100. The user input unit 130 may include a plurality of manipulating units 131 and 132. The manipulating units 131 and 132 may be called a manipulating portion and may adopt any mechanism of a tactile manner that enables a user to perform a manipulation action by experiencing a tactile feeling.

Content inputted by the first manipulating unit 131 or the second manipulating unit 132 may be diversely set. For example, a command such as start, end, scroll and/or the like may be inputted to the first manipulating unit 131. A command for a volume adjustment of sound outputted from the audio output unit 152, a command for a switching to a touch recognizing mode of the display 151 or the like may be inputted to the second manipulating unit 132.

Figure 2B:
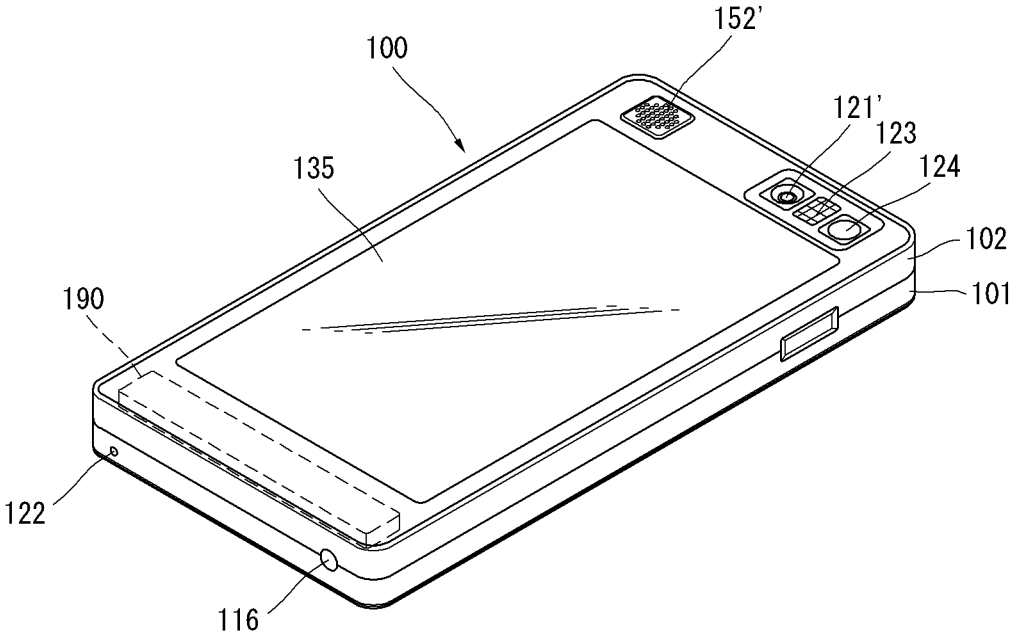
FIG. 2B is a perspective diagram of the backside of the mobile terminal shown in FIG. 2A.

FIG. 2B is a perspective diagram of a backside of the mobile terminal shown in FIG. 2A. Other embodiments, configurations and arrangements may also be provided.

As shown in FIG. 2B, a camera 121' may be additionally provided on a backside of the terminal body, and more particularly on the rear case 102. The camera 121' may have a photographing direction that is substantially opposite to a photographing direction of the camera 121 (shown in FIG. 2A) and may have pixels differing from pixels of the camera 121.

For example, the camera 121 may have a lower number of pixels to capture and transmit a picture of user's face for a video call, while the camera 121' may have a greater number of pixels for capturing a general subject for photography without transmitting the captured subject. Each of the cameras 121 and 121' may be installed on the terminal body to be rotated and/or popped up.

A flash 123 and a mirror 124 may be additionally provided adjacent to the camera 121'. The flash 123 may project light toward a subject in case of photographing the subject using the camera 121'. If a user attempts to take a picture of the user (self-photography) using the camera 121', the mirror 124 may enable the user to view a user's face reflected by the mirror 124.

An additional audio output unit 152' may be provided on the backside of the terminal body. The additional audio output unit 152' may implement a stereo function together with the audio output unit 152 shown in FIG. 2A and may be used for implementation of a speakerphone mode in talking over the terminal.

A broadcast signal receiving antenna 124 may be additionally provided at the lateral side of the terminal body as well as an antenna for communication or the like. The antenna 124 may be considered a portion of the broadcast receiving module 111 shown in FIG. 1 and may be retractably provided on the terminal body.

The power supply 190 for supplying a power to the mobile terminal 100 may be provided to the terminal body. The power supply 190 may be built within the terminal body. Alternatively, the power supply 190 may be detachably connected to the terminal body.

FIG. 2B also shows a touchpad 135 for detecting a touch that is additionally provided on the rear case 102. The touchpad 135 may be configured in a light transmittive type like the display 151. If the display 151 outputs visual information from both faces, the display 151 may recognize visual information via the touchpad 135 as well. The information outputted from both of the faces may be controlled by the touchpad 135. Alternatively, a display may be further provided to the touchpad 135 so that a touchscreen may also be provided to the rear case 102.

The touchpad 135 may be activated by interconnecting with the display 151 of the front case 101. The touchpad 135 may be provided in rear of the display 151 in parallel to one another. The touchpad 135 may have a size equal to or less than a size of the display 151.

Figure 3:
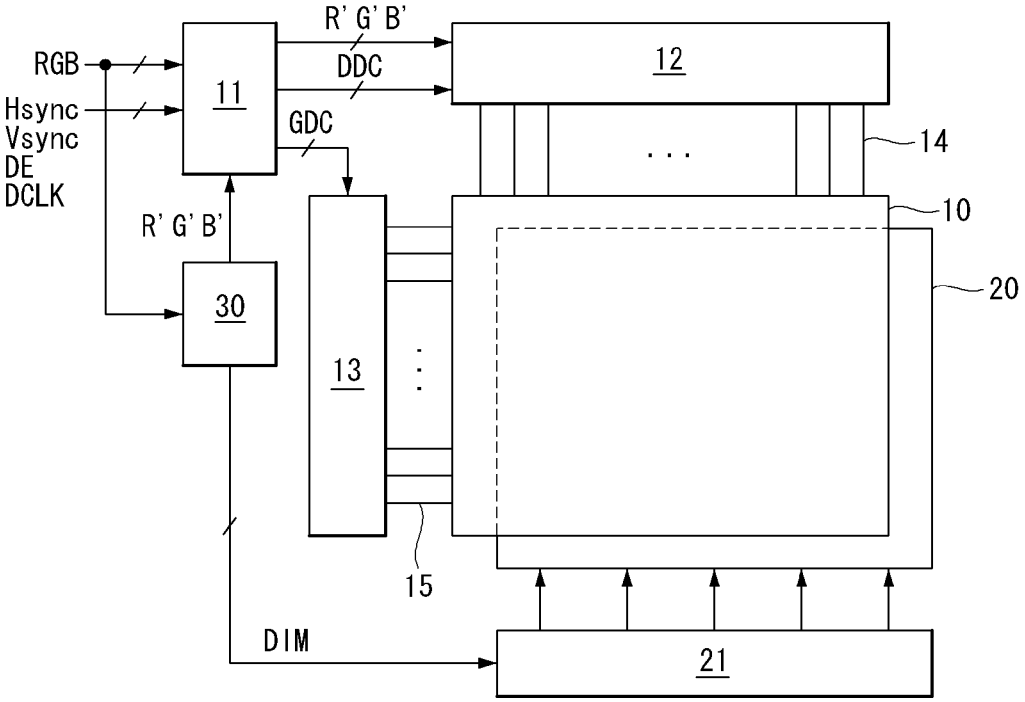
FIG. 3 illustrates a liquid crystal device according to an example embodiment of the present invention.

FIG. 3 illustrates a liquid crystal display according to an example embodiment of the present invention. The liquid crystal display shown in FIG. 3 illustrates the display 151 described above.

Referring to FIG. 3, the liquid crystal display according to the present invention includes a liquid crystal display panel 10, a source driver 12 driving data lines 14 of the liquid crystal display panel 10, a gate driver 13 driving gate lines 15 of the liquid crystal display panel 10, a timing controller 11 controlling the source driver 12 and the gate driver 13, a backlight unit 20 emitting light to the liquid crystal display panel 10, a light source driver 21 driving light sources of the backlight unit 20, and a dimming controller 30 controlling global dimming.

The liquid crystal display panel 10 includes a liquid crystal layer between two glass substrates. A lower glass substrate of the liquid crystal display panel 10 includes a plurality of data lines 14, a plurality of gate lines 15 intersecting the data lines 14, thin film transistors (TFTs) formed at the crossings of the data lines 14 and the gate lines 15, pixel electrodes respectively connected to the TFTs, and a storage capacitor Cst. Due to the intersecting arrangements of the data lines 14 and the gate lines 15, pixels are arranged on the liquid crystal display panel 10 in a matrix configuration.

An upper glass substrate of the liquid crystal display panel 10 includes a black matrix, a color filter, and a common electrode. In a vertical field driving mode such as a Twisted Nematic (TN) mode and a Vertical Alignment (VA) mode, the common electrode is formed on the upper glass; however, in a horizontal field driving mode such as an In-Plane Switching (IPS) mode and a Fringe Field Switching (FFS) mode, it is formed on the lower glass substrate. A polarizer is attached to each of the upper and lower glass substrates of the liquid crystal display panel 10, and an alignment layer for setting the pre-tilt angle of liquid crystals are formed on the inner surface coming into contact with liquid crystals.

The timing controller 11 receives digital video data RGB of an input image and timing signals Vsync, Hsync, DE, and DCLK from an external system board. The timing signals Vsync, Hsync, DE, and DCLK includes a vertical synchronizing signal Vsync, a horizontal synchronizing signal Hsync, a data enable signal DE, a dot clock signal DCLK, and/or the like. The timing controller 11 generates timing control signals DDC and GDC for controlling the operating timing of the source driver 12 and the gate driver 13 on the basis of the timing signals Vsync, Hsync, DE, and DCLK from the external system board. The system board or the timing controller 11 inserts an interpolation frame between frames of an input image signal inputted at a frame frequency of 60 Hz and multiples a gate timing control signal GDC with a source timing control signal DDC so that the operations of the source driver 12 and the gate driver 13 can be controlled with a frame frequency of 60×N Hz where N is a positive integer which is not less than 2.

The timing controller 11 supplies digital video data RGB of an input image, inputted from the external system board, to the dimming controller 30, and delivers digital video data R'G'B', modulated by the local dimming controller 30, to the source driver 12.

The source driver 12 latches the digital video data R'G'B' under control of the timing controller 11. The source driver 12 converts the digital video data R'G'B' into a positive/negative analog data voltage by using a positive/negative gamma compensation voltage and supplies it to the data lines 14.

The gate driver 13 sequentially outputs gate pulses (or scan pulses) to select pixels to which data is to be written. The gate pulses are sequentially supplied to the gate lines in synchronization with a data voltage being supplied to the data lines 14 and sequentially supplied to the gate lines 15.

The backlight unit 20 is disposed under the liquid crystal display panel 10*a* and emits backlight to the liquid crystal display panel 10. The backlight unit 20 includes a plurality of light sources, and may be implemented into a direct type backlight unit or an edge type backlight unit. The light sources of the backlight unit 20 may include at least one or two or more types of light sources among Hot Cathode Fluorescent Lamps (HCFL), Cold Cathode Fluorescent Lamps (CCFL), External Electrode Fluorescent Lamps (EEFL), and Light Emitting Diodes (LED).

The light source driver 21 controls luminance of the light sources of the backlight unit 20 by using Pulse Width Modulation (PWM) by which a duty ratio is varied according to a dimming value (DIM) inputted from the dimming controller 30. A PWM signal controls the ratio between lighting and lighting-out of the light sources, and the duty ratio (%) is determined according to a dimming value (DIM) inputted from the dimming controller 30.

The dimming controller 30 receives digital video data (RGB) of an input image, namely, pixel data, calculates the histogram of the input image, and calculates a CDF or a CCDF on the basis of equation 1 or 2. The dimming controller 30 calculates an area of the input image on the basis of the CDF or CCDF and compares the area value with an area threshold value preset in a lookup table, thus determining a final MLD value satisfying an image-quality index of a predetermined level or higher. The dimming controller 30 generates a dimming value (DIM) for controlling the backlight luminance to the final MLD value or less. Furthermore, the dimming controller 30 calibrates pixel data of an input image using a preset calibration algorithm so as to calibrate transmittance of the liquid crystal display panel 20 according to a reduction in the backlight luminance, thereby generating modulated data R'G'B', and supplies the data R'G'B' to the timing controller 11. The dimming controller 30 may be configured within the timing controller 11.

Meanwhile, the dimming controller 30 may be configured separately from the controller 180 or incorporated into the controller 180.

Figure 4:
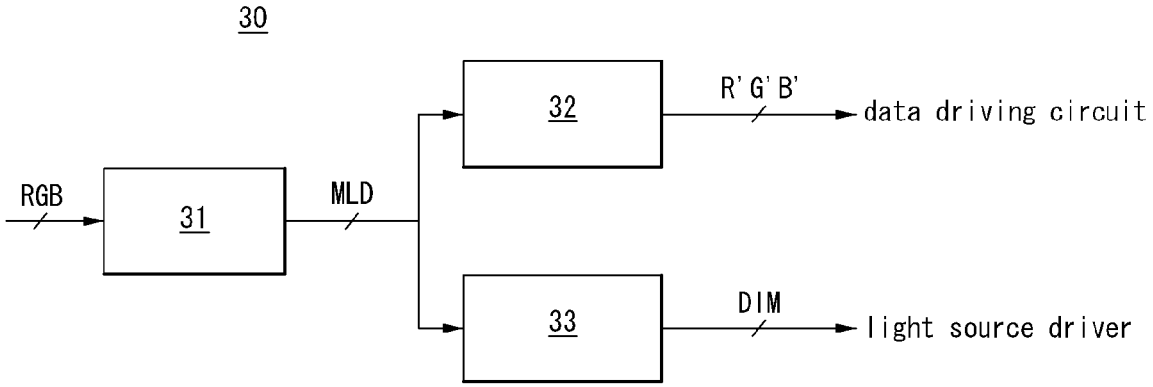
FIG. 4 is a block diagram illustrating a dimming controller 30 in detail.

FIG. 4 is a block diagram illustrating the dimming controller 30 in detail.

Referring to FIG. 4, the dimming controller 30 includes an MLD determination part 31, a backlight control part 33, and an image calibration part 32.

The MLD determination part 31 receives pixel data RGB of an input image. The MLD determination part 31 calculates a histogram of the input image, calculates an area while increasing MLD_i on the basis of the CDF or CCDF of the histogram, and compares the area value with an area threshold value preset in a lookup datable, thus determining a final MLD value satisfying an image-quality index of a predetermined level or higher.

The backlight luminance controller 33 controls the backlight driver 21 and lowers the backlight luminance by K/MIL (=255) where K denotes a clipped point of the final MLD value. The image calibration part 32 increases pixel data RGB of the input image by MIL(=255)/K so that the reduction in the backlight luminance is compensated for with the increase in the transmittance of the liquid crystal display panel 10.

Figure 5:
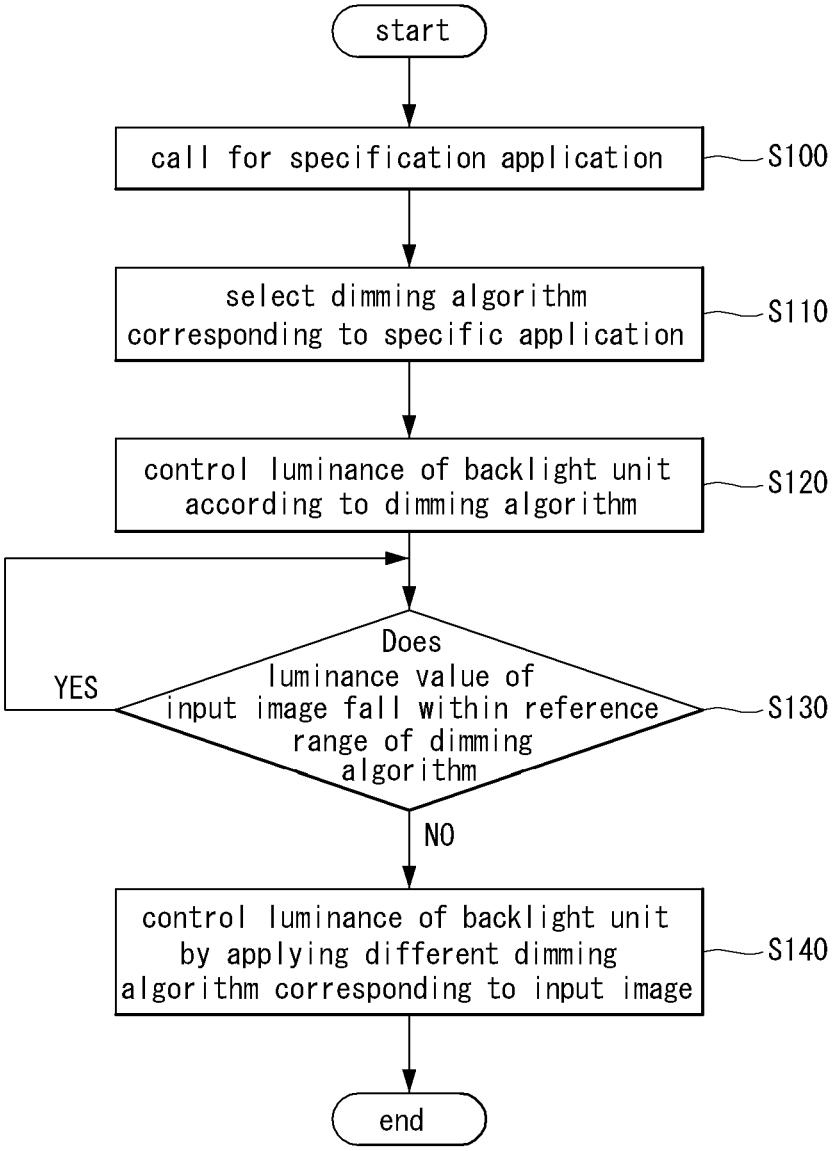
FIG. 5 is a flowchart of a method of controlling a mobile terminal according to an example embodiment of the present invention.

FIG. 5 is a flowchart of a method of controlling a mobile terminal according to an example embodiment of the present invention. FIGS. 6 through 14 are views for explaining the method of controlling a mobile terminal according to an example embodiment of the present invention.

The method of controlling a mobile terminal according to an example embodiment of the present invention can be implemented in the mobile terminal 100 described above with reference to FIGS. 1 through 4. Hereinafter, the method of controlling a mobile terminal, and operations of the mobile terminal 100 for implementation of the method according to an example embodiment of the present invention will be described in detail.

The mobile terminal 100 may include both the controller 180 and the dimming controller 30 or only the controller 180, and the controller 180 may perform all the functions performed by the dimming controller 30, described above with reference to FIGS. 3 and 4. Hereinafter, for ease of description, it is assumed that the controller 180 is capable of performing all the functions of the dimming controller 30 and controls every operation for implementing the technical aspects of the present invention.

The controller 180 may call for a specific application stored in the memory 160 in operation S100.

The memory 160 may store various applications including the specific application.

Furthermore, the memory 160 may store a database defining a matching relationship between the application and a dimming algorithm. For example, the specific application may be matched with a specific dimming algorithm among a plurality of dimming algorithms stored in the database.

FIGS. 6 through 11 are views for explaining various dimming algorithms. Various examples of dimming algorithms will now be described with reference to FIGS. 6 through 11.

Figure 6:
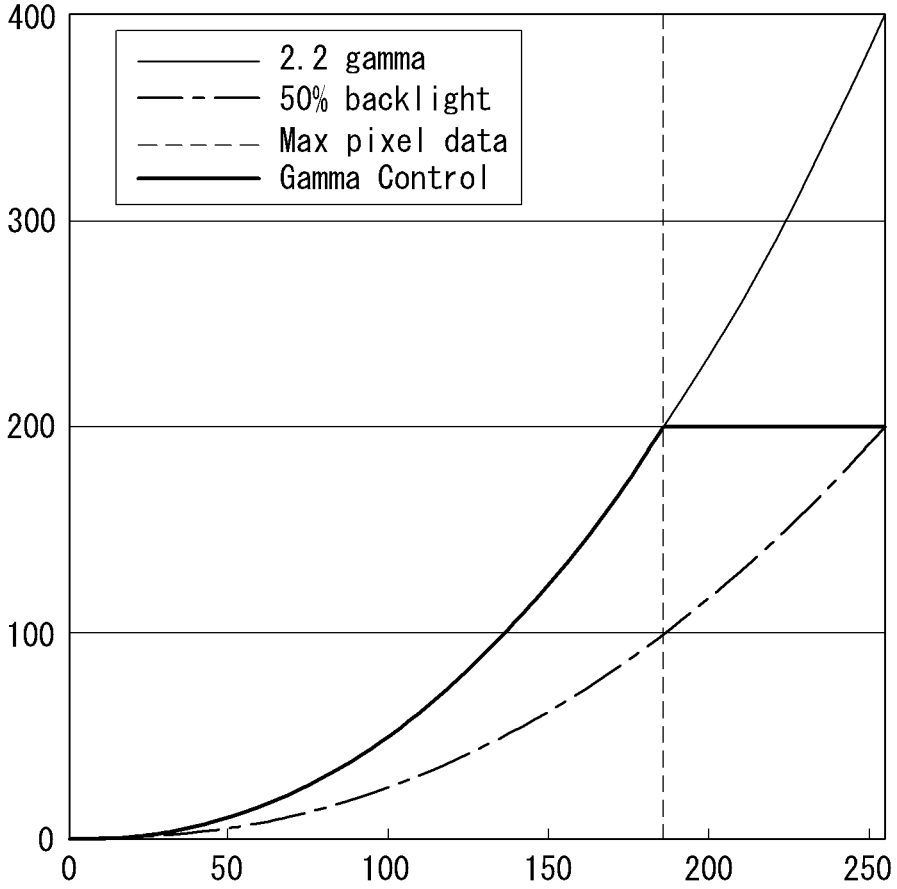
FIGS. 6 through 14 are views for explaining a method of controlling a mobile terminal according to an example embodiment of the present invention.

A first dimming algorithm shown in FIG. 6 detects the maximum luminance of a first frame image from an input image, lowers the luminance of the backlight unit 20 by the maximum luminance, and up-converts pixel data included in the input to thereby compensate for the lowered luminance of the backlight unit 20.

Figure 7:
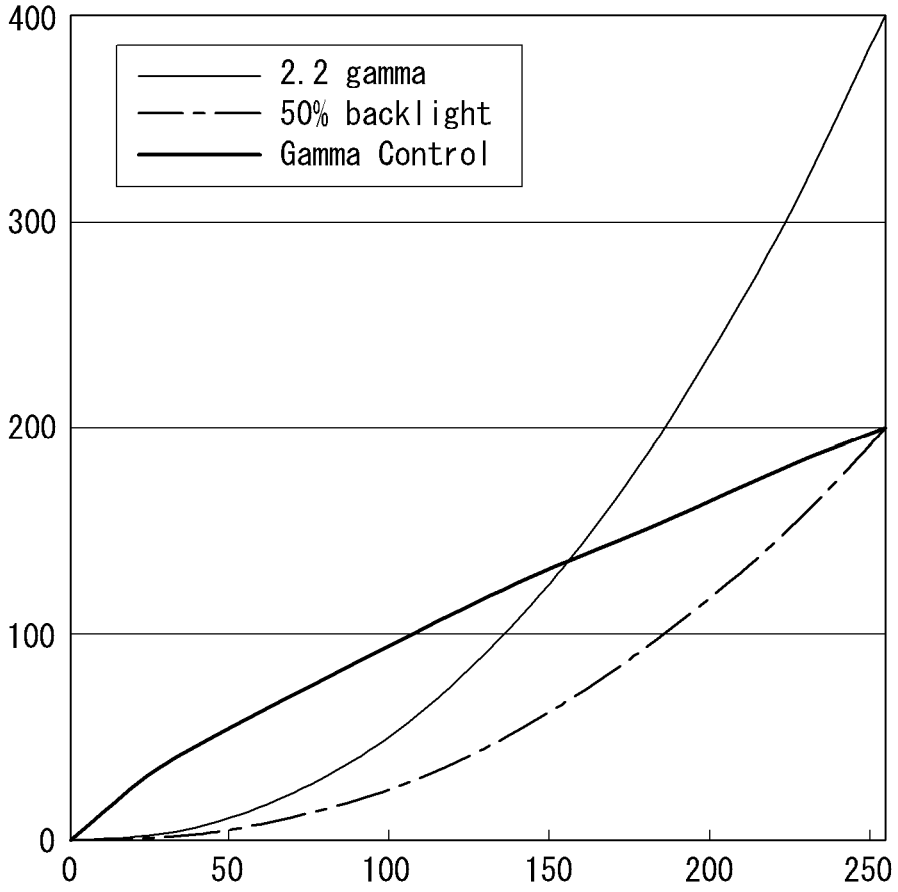

A second dimming algorithm shown in FIG. 7 calculates an average picture level (APL) of a first frame image from an input image, lowers the luminance of the backlight unit 20 by the luminance of the APL, up-converts pixel data included in the input image, writes the up-converted pixel data in the liquid crystal display panel 10 to thereby compensate for the lowered luminance of the backlight unit 20.

Figures 8, 9:
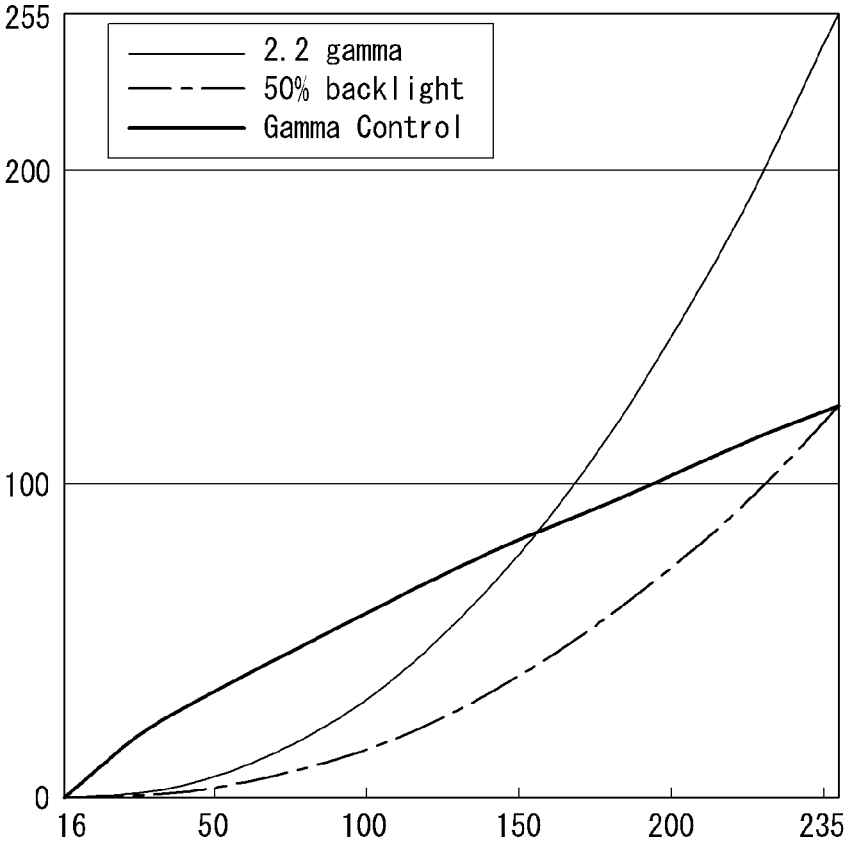
Figures 10, 11:
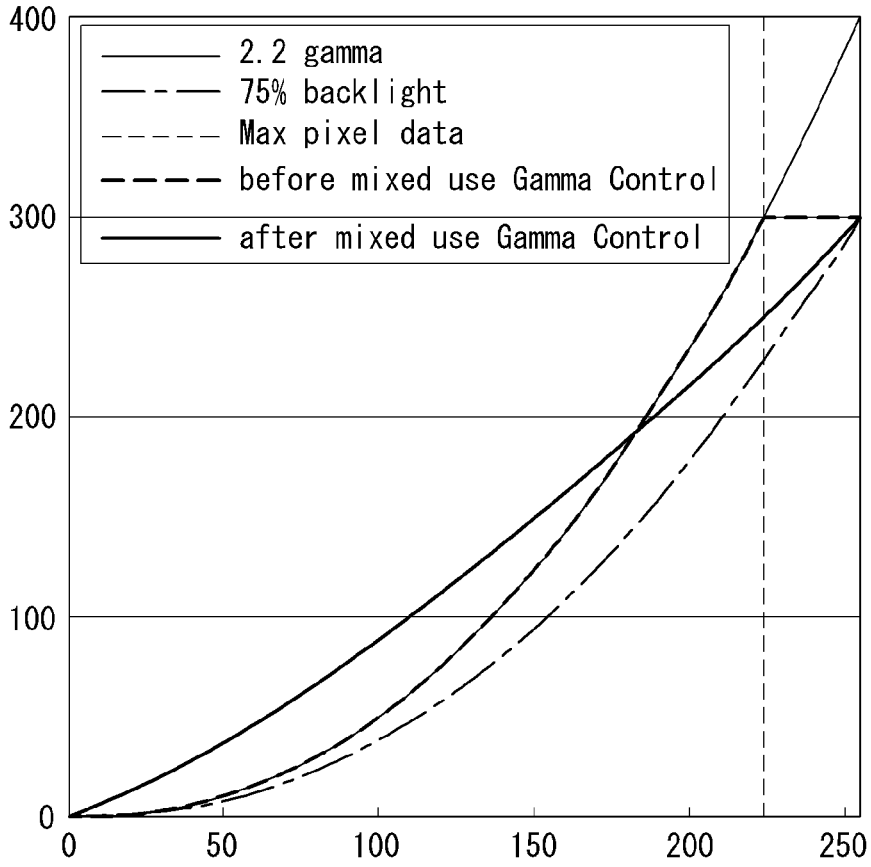

A third dimming algorithm shown in FIG. 8 calculates an average picture level (APL) of a first frame image from an input image, lowers the luminance of the backlight unit 20 by the luminance of the APL, up-converts only a luminance value by separating the luminance value from a chrominance value in each pixel data of the input image, calculates pixel data, which is up-converted in terms of gamma characteristics, with the up-converted luminance value and the original chrominance value, and writes the calculated pixel data in the liquid crystal display panel 10. FIGS. 9 and 10 are views illustrating calculation equations associated with the third dimming algorithm depicted in FIG. 8.

A fourth dimming algorithm shown in FIG. 11 detects the maximum luminance of a first frame from an input image, executes the first dimming algorithm when the maximum luminance is not greater than a preset maximum luminance reference value, and executes one of the second and third dimming algorithms when the maximum luminance is greater than the preset maximum luminance reference value.

That is, the fourth dimming algorithm makes conversion from the first dimming algorithm to the second or third dimming algorithm on the basis of the preset maximum luminance.

The first to fourth dimming algorithms described above are applicable to Content Adapted Brightness Control (CABC). The CABC refers to a method of controlling luminance according to contents (input image).

According to technical aspects of the present invention, the first to fourth dimming algorithms may be used differently depending on an application. That is, when an application is changed, a dimming algorithm being used is also changed.

The database stored in the memory 160 may define a matching relationship between various algorithms and various applications.

Figures 12, 13:
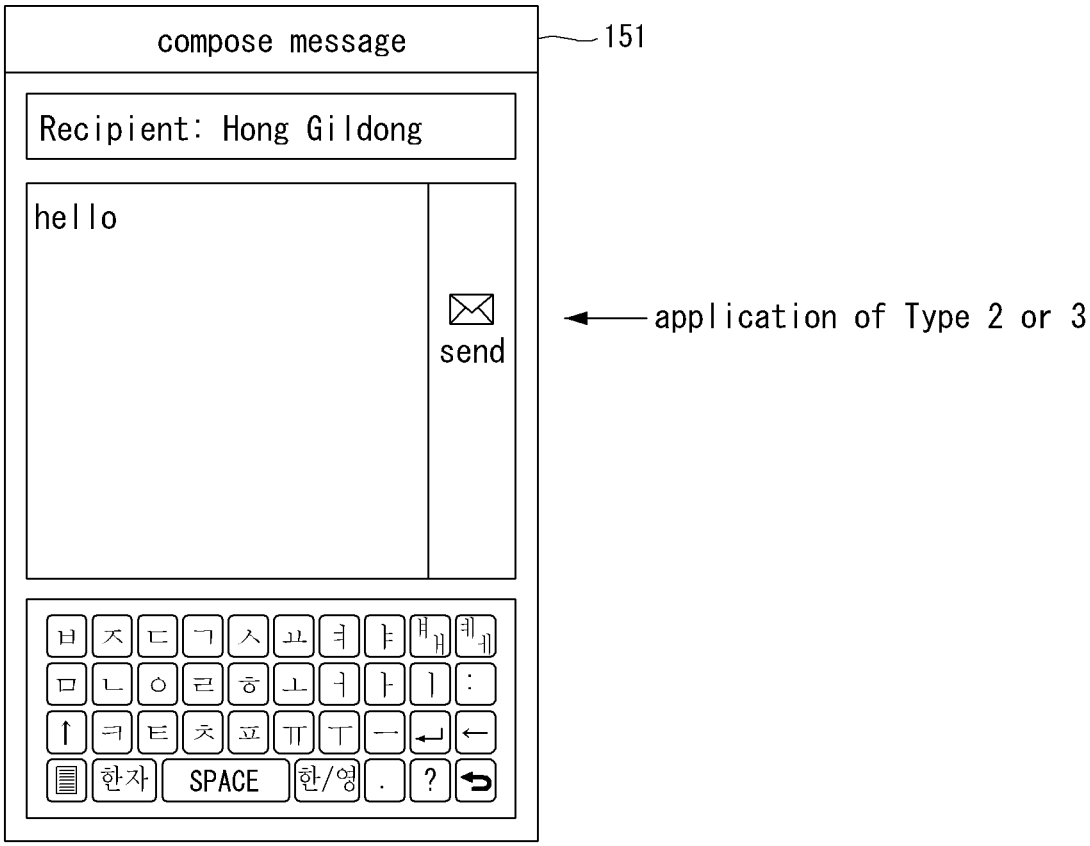

FIG. 12 illustrates examples of matching relationships between dimming algorithms and applications. In FIG. 12, TYPE 1 to TYPE 4 represent the first to fourth dimming algorithms, respectively.

The matching relationship between dimming algorithms and applications may be determined in due consideration of preset criteria including the importance of image quality.

For example, the first dimming algorithm does not cause any deterioration in image quality; however, it fails to reduce power consumption when full white (Gray 255) is present in any pixel data of a frame image.

Also, for example, the second dimming algorithm achieves at least the minimum power-saving effect in every image. However, the second dimming algorithm has a limitation in that deterioration in image quality occurs as the power-saving effect is boosted.

Thus, the first dimming algorithm may be applied to an application where image quality is considered relatively important, while the second dimming algorithm may be applied to an application where image quality is considered relatively less important.

The third dimming algorithm may also be applied to an application where image quality is considered relatively less important.

In general, the yellowish phenomenon of a skin color and color degradation occur in an RGB domain. Thus, the third dimming algorithm applies CABC image improvements only to Y, which is a brightness factor in a YCbCr domain. When an image is calibrated using Y, which is a brightness factor in the YCbCr domain, only brightness is changed without changing chrominance components. Therefore, as compared with the second dimming algorithm where calibration is performed in an RGB domain, the third dimming algorithm does not bring about skin-color degradation and color degradation.

Meanwhile, according to the fourth dimming algorithm, conversion from the first dimming algorithm to the second or third dimming algorithm occurs on the basis of the preset maximum luminance, which can thus ensure the minimum power-saving effect. Here, the preset maximum luminance may be arbitrarily set in due consideration of a desired minimum power-saving effect.

However, the fourth dimming algorithm may be applicable to a discontinuous image such as a still-image viewer because, if algorithm conversion occurs in a video where images are continuously changing, a viewer may feel the changes in the screen.

The database defining the matching relationship between applications and dimming algorithms may be determined in due consideration of predetermined criteria such as importance of image quality, power-saving degree, and/or the like.

The controller 180 may choose a dimming algorithm corresponding to the specific application in operation S110.

For example, referring to FIG. 13, the controller 180 may enter a screen corresponding to a message application by a message write command from a user in operation S100.

Considering that the message application does not necessarily have good image quality, the second or third dimming algorithm may be set in advance to be applied thereto as shown in FIG. 12.

When the message application depicted in FIG. 13 is called for, the controller 180 may choose the second or third dimming algorithm corresponding to the message application while or right before accessing the message.

In calling for and executing the specific application, the controller 180, in operation S120, may control the luminance of the backlight unit 20 according to the dimming algorithm chosen in operation S110.

For example, in FIG. 13, the controller 180 may control the luminance of the backlight unit 20 by applying the second or third dimming algorithm to the execution of the message application.

In operation S130, the controller 180, while executing the specific application, may determine whether or not a luminance value of an input image falls within a reference luminance range corresponding to the dimming algorithm chosen in operation S110.

When it is determined in operation S130 that the luminance value of the input image falls outside the corresponding reference luminance range, the controller 180 may control the luminance of the backlight unit 20 by applying a different dimming algorithm corresponding to the luminance value of the input image in operation S140.

For example, a user may want to attach a picture to a message that the user is writing. Herein, since techniques for attaching a picture to a message are known, a detailed description thereof will be omitted.

Figure 14:
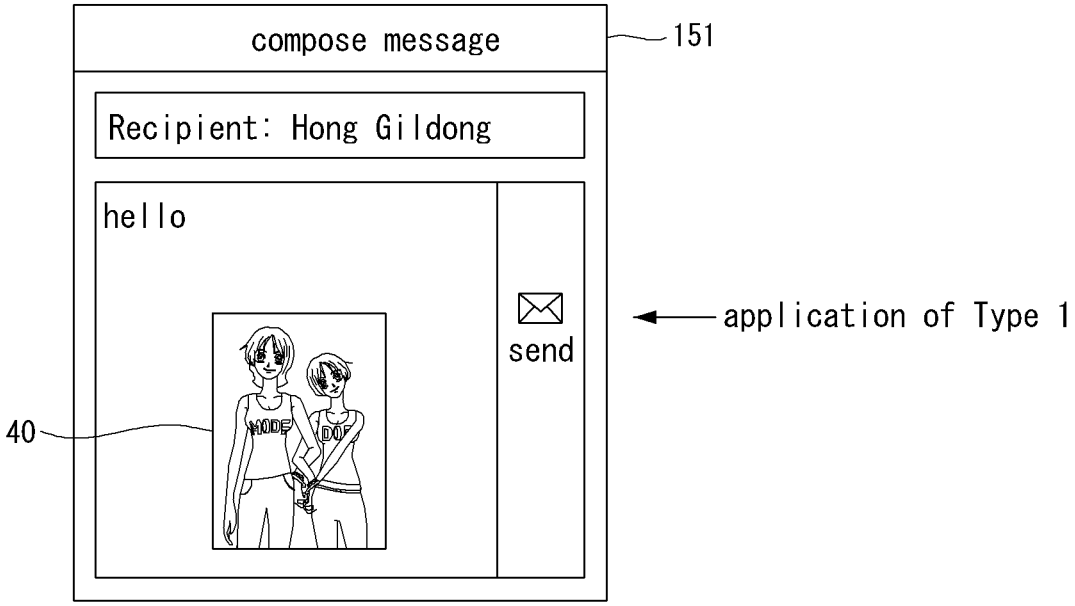

In general, when a picture is attached to a message, the controller 180 may display the attached picture 40 on the display 151 in entirety or in the form of a preview image as shown in FIG. 14.

In this case, when a luminance value of the attached picture 40 goes out of a reference luminance range corresponding to the second or third dimming algorithm, the controller 180 may control the luminance of the backlight unit 20 by applying the first dimming algorithm thereto.

The application of the first dimming algorithm prevents degradation in image quality with respect to the attached picture 40. However, if the second or third dimming algorithm rather than the first dimming algorithm is continuously used, the possibility of degradation in image quality of the attached picture 40 is significantly increased.

Here, it is assumed that a user has deleted the attached picture 40 because the user does not like the attached picture 40.

Since the attached picture 40 has been deleted, the controller 180 stops the application of the first dimming algorithm and resumes the applications of the second or third dimming algorithm which was initially matched with the message application.

The above example embodiment of the present invention has used the message application by way example, but it should be noted that technical aspects of the invention are not limited just to the message application.

The matching relationship between the dimming algorithms and applications, exemplified in FIG. 12, may be set prior to product release by a manufacturer of the mobile terminal 100 and stored in the database.

Of late, mobile terminals and electronic devices such as smart phones, and tablet PCs use 3G or 4G communication networks to support functions for freely downloading and installing a variety of applications.

When a user downloads a specific application and installs it in the mobile terminal 100, the controller 180 may acquire information regarding image-quality characteristics of the specific application at the time of initial downloading thereof (or at the time of the first execution after downloading), select a dimming algorithm conforming to the acquired information regarding image-quality characteristics from among various dimming algorithms (e.g., the first to fourth dimming algorithms), match the selected dimming algorithm with the specific application, and store it in the database.

The controller 180 may acquire the image regarding image-quality characteristics by using information provided by the specific application (e.g., header information or attribute information).

Also, the controller 180 may acquire the information regarding image-quality characteristics by directly scanning an image frame of a specific screen included n the specific application in the units of pixels.

Furthermore, the controller 180 may provide a user interface for the acquisition of the image regarding image-quality characteristics at the time of downloading or installing the specific application, and acquire the image regarding image-quality characteristics of the specific application through the user interface.

Figure 15:
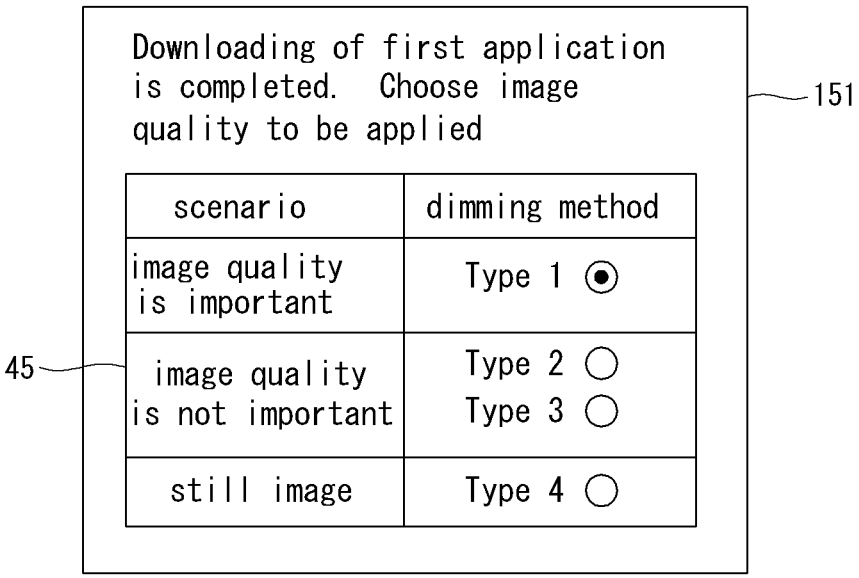
FIG. 15 is a view illustrating an example of a user interface provided to acquire information regarding image-quality characteristics in downloading a specific application.

FIG. 15 is a view illustrating an example of a user interface provided to acquire information regarding image-quality characteristics in downloading a specific application.

For example, referring to FIG. 15, before or after the completely downloaded specific application is installed in the mobile terminal 100, the controller 180 may provide a user interface 45 allowing for selection of a dimming algorithm to be applied in executing the specific application.

A user may select a desired dimming algorithm by using the user's knowledge or information provided to the user interface 45. The selected dimming algorithm may be changed or reconfigured by the user.

Furthermore, when the fourth dimming algorithm is applied for a specific application or screen, the controller 180 may provide a user with a user interface allowing the user to set the minimum power saving strength. Here, when the user increases the minimum power saving strength, a reference point of the maximum luminance is lowered, which thus is in proportion to degradation in image quality.

Also, as described above, the fourth dimming algorithm may be applied to an application where no change in an input image occurs on a time axis, such as a still image viewer, but this is not always the case.

For example, in the case of high-speed search such as slipping, the fourth dimming algorithm is applicable even to an application where changes in an input image occur on the time axis. This is possible because a change in an image caused by algorithm conversion is hard to recognize since the high-speed search such as slipping renders the input image discontinuous on the time axis.

Meanwhile, a communication module may be additionally configured in the liquid crystal display (corresponding to the display 151) described with reference to FIGS. 3 and 4.

Figure 16:
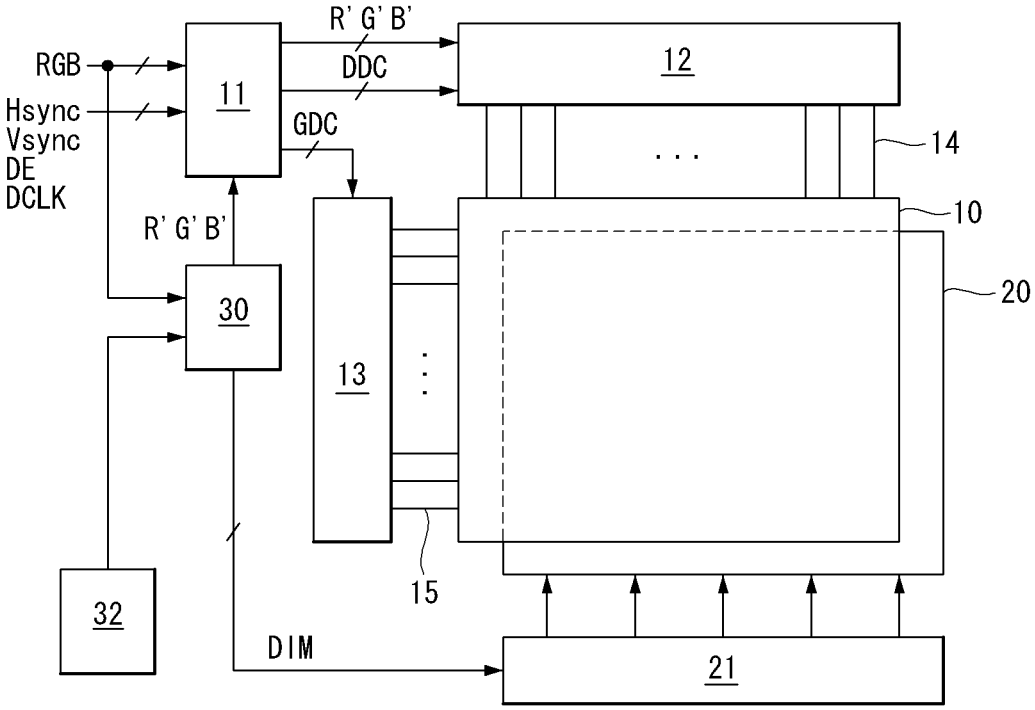
FIG. 16 is a view illustrating a case where the liquid crystal display is provided with a communication module.

FIG. 16 is a view illustrating a case where the liquid crystal display is provided with a communication module.

For example, referring to FIG. 16, the liquid crystal display 151 is provided with a communication module that can communicate with an external network (e.g., an access point), and the liquid crystal display 151 itself may receive a dimming algorithm through the communication module.

The mobile terminal and the method of controlling the mobile terminal according to the present invention have the following effects.

According to the present invention, a different backlight dimming algorithm is applied according to an application, thus allowing for backlight dimming reflecting characteristics of the application.

Also, according to the present invention, a dimming algorithm is selectively applied in association with an input image during execution of a specific application, thereby allowing for backlight dimming reflecting characteristics of an input image even within the specific application.

The above described method of controlling a mobile terminal according to the present invention can be written as computer programs and can be implemented in digital computers that execute the programs using a computer readable recording medium.

The method of controlling a mobile terminal according to embodiments of the present invention can be executed through software. The software can include code segments that perform required tasks. Programs or code segments can also be stored in a processor readable medium and transmitted.

The computer readable recording medium includes all types of recording devices storing data readable by computer systems. Examples of the computer readable recording medium include ROM, RAM, CD-ROM, DVD±ROM, DVD-RAM, magnetic tapes, floppy disks, hard disks, and optical data storage devices. The computer readable recording medium can also be distributed over network coupled computer systems so that the computer readable code is stored and executed in a distributed fashion.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A mobile terminal, comprising:

a liquid crystal display panel configured to display information;

a backlight unit configured to emit backlight to the liquid crystal display panel;

a memory configured to store a matching relationship between each application of at least one installed application and a corresponding dimming algorithm among a plurality of dimming algorithms; and a controller configured to:

select a first dimming algorithm from among the plurality of dimming algorithms stored in the memory in response to a first input for executing a specific application, wherein the first dimming algorithm has the matching relationship with the specific application;

control the liquid crystal display panel to display an execution screen of the specific application based on the selected first dimming algorithm;

control the backlight unit to change the first dimming algorithm to a second dimming algorithm among the plurality of dimming algorithms in response to a second input causing display of an image on the execution screen, the image having a luminance value that is outside a reference luminance range set for the execution screen, wherein the second dimming algorithm is selected based on the luminance value of the image; and control the liquid crystal display panel to display the execution screen based on the selected second dimming algorithm, wherein the execution screen displayed based on the second dimming algorithm includes the image.

2. The mobile terminal of claim 1, wherein selecting the first or second dimming algorithm comprises referencing a database stored in the memory, the database including the matching relationship.

3. The mobile terminal of claim 2, wherein the matching relationship for each application is defined based on preset criteria comprising importance of image quality or a degree of power saving.

4. The mobile terminal of claim 2, wherein the controller is further configured to:

download the specific application from a source outside the mobile terminal;

install the specific application;

acquire information regarding image quality characteristics of the specific application;

select the first dimming algorithm based on the acquired information;

match the selected first dimming algorithm with the specific application; and store the selected first dimming algorithm for the specific application in the database.

5. The mobile terminal of claim 4, wherein acquiring the information regarding the image quality characteristics comprises receiving information while downloading the specific application or while scanning an image frame of a specific screen included in the specific application.

6. The mobile terminal of claim 4, wherein the controller is further configured to:

provide a user interface configured to acquire the information regarding image quality characteristics during the installation of the specific application; and acquire the information via the user interface.

7. The mobile terminal of claim 1, wherein the controller is further configured to:

convert the execution screen providing the specific application to a second screen, which is different from the execution screen, when the image is displayed on the liquid crystal display panel while the specific application is executed; and control the liquid crystal display panel to display the image on the second screen.

8. The mobile terminal of claim 1, wherein the controller is further configured to:

insert specific contents into the execution screen when the image is displayed on the liquid crystal display panel while the specific application is executed; and control the liquid crystal display panel to display the image on the execution screen.

9. The mobile terminal of claim 1, wherein:

the first dimming algorithm is configured to:

detect a maximum luminance of a first frame image from the image;

lower luminance of the backlight by an amount equal to the maximum luminance; and up-convert pixel data included in the image; and the up-converted pixel data compensates for the lowered luminance of the backlight.

10. The mobile terminal of claim 9, wherein:

the second dimming algorithm is configured to:

calculate an average picture level (APL) of the first frame image from the image;

lower luminance of the backlight by an amount equal to luminance of the APL;

up-convert pixel data included in the image; and write the pixel data in the liquid crystal display panel, wherein writing the pixel data in the liquid crystal display panel compensates for the lowered luminance of the backlight.

11. The mobile terminal of claim 10, wherein the plurality of dimming algorithms comprises a third dimming algorithm, the third dimming algorithm configured to:

calculate the APL of the first frame image from the image;

lower luminance of the backlight by the amount equal to the luminance of the APL;

separate a luminance value and a chrominance value from each other in each of at least one pixel data of the image;

up-convert only the luminance value of the separated luminance and chrominance values;

up-convert the pixel data in terms of gamma characteristics;

calculate the pixel data with the up-converted luminance value and an original chrominance value; and write the calculated pixel data in the liquid crystal display panel.

12. The mobile terminal of claim 11, wherein the controller is further configured to:

detect the maximum luminance of the first frame image from the image;

execute the first dimming algorithm when the maximum luminance is less than or equal to a preset maximum luminance reference value; and execute the second dimming algorithm or the third dimming algorithm when the maximum luminance is greater than the preset maximum luminance reference value.

13. A method of controlling a mobile terminal, the method comprising:

storing, in a memory of the mobile terminal, a matching relationship between each application of at least one installed application and a corresponding dimming algorithm among a plurality of dimming algorithms;

selecting, via a controller of the mobile terminal, a first dimming algorithm from among the plurality of dimming algorithms in response to a first input for executing a specific application, wherein the first dimming algorithm has the matching relationship with the specific application;

displaying an execution screen of the specific application based on the selected first dimming algorithm;

changing the first dimming algorithm to a second dimming algorithm in response to a second input causing display of an image on the execution screen, the image having a luminance value that is outside a reference luminance range set for the execution screen, wherein the second dimming algorithm is selected based on the luminance value of the image; and displaying the execution screen based on the selected second dimming algorithm, wherein the execution screen displayed based on the second dimming algorithm includes the image.

14. The method of claim 13, wherein selecting the first or second dimming algorithm comprises referencing a database stored in the memory, the database including the matching relationship.

15. The method of claim 14, wherein the matching relationship for each application is defined based on preset criteria comprising importance of image quality or a degree of power saving.

16. The method of claim 14, further comprising:

downloading the specific application from a source outside the mobile terminal via the controller;

installing the specific application via the controller;

acquiring information regarding image quality characteristics of the specific application via the controller;

selecting the first dimming algorithm based on the acquired information via the controller;

matching the selected first dimming algorithm with the specific application via the controller; and storing the selected first dimming algorithm for the specific application in the database.

17. The method of claim 16, wherein acquiring the information regarding the image quality characteristics comprises:

receiving information, via the controller, while downloading the specific application or while scanning an image frame of a specific screen included in the specific application.

18. The method of claim 16, further comprising:

providing, via the controller, a user interface configured to acquire the information regarding image quality characteristics during the installation of the specific application; and acquiring the information via the user interface.

19. The method of claim 13, wherein:

the first dimming algorithm is configured to:

detect a maximum luminance of a first frame image from the image;

lower luminance of the backlight by an amount equal to the maximum luminance; and up-convert pixel data included in the image; and the up-converted pixel data compensates for the lowered luminance of the backlight.

20. The method of claim 19, wherein:

the second dimming algorithm is configured to:

calculate an average picture level (APL) of the first frame image from the image;

lower luminance of the backlight by an amount equal to luminance of the APL;

up-convert pixel data included in the input image; and write the pixel data in the liquid crystal display panel, wherein writing the pixel data in the liquid crystal display panel compensates for the lowered luminance of the backlight.

21. The method of claim 20, wherein the plurality of dimming algorithms comprises a third dimming algorithm, the third dimming algorithm configured to:

calculate the APL of the first frame image from the image;

lower luminance of the backlight by the amount equal to the luminance of the APL;

separate a luminance value and a chrominance value from each other in each of at least one pixel data of the image;

up-convert only the luminance value of the separated luminance and chrominance values;

up-convert the pixel data in terms of gamma characteristics;

calculate the pixel data with the up-converted luminance value and an original chrominance value; and write the calculated pixel data in the liquid crystal display panel.

22. The method of claim 21, further comprising:

detecting the maximum luminance of the first frame image from the image via the controller;

executing the first dimming algorithm, via the controller, when the maximum luminance is less than or equal to a preset maximum luminance reference value; and executing the second dimming algorithm or the third dimming algorithm, via the controller, when the maximum luminance is greater than the preset maximum luminance reference value.

* * * * *